US008360161B2

(12) United States Patent
Buytaert et al.

(10) Patent No.: US 8,360,161 B2
(45) Date of Patent: Jan. 29, 2013

(54) DOWNHOLE DEVICE ACTUATOR AND METHOD

(75) Inventors: Jean Buytaert, Mineral Wells, TX (US); Eugene Miller, Weatherford, TX (US)

(73) Assignee: Frank's International, Inc., Houston, TX (US)

( * ) Notice: Subject to any disclaimer, the term of this patent is extended or adjusted under 35 U.S.C. 154(b) by 438 days.

(21) Appl. No.: 12/569,811

(22) Filed: Sep. 29, 2009

(65) Prior Publication Data

US 2010/0078173 A1 Apr. 1, 2010

Related U.S. Application Data

(60) Provisional application No. 61/101,100, filed on Sep. 29, 2008, provisional application No. 61/239,195, filed on Sep. 2, 2009.

(51) Int. Cl.
*C22F 1/00* (2006.01)
*E21B 23/00* (2006.01)
*E21B 33/128* (2006.01)

(52) U.S. Cl. ..... 166/387; 166/302; 166/119; 277/338; 277/340; 277/650; 148/402; 148/563

(58) Field of Classification Search ..... 166/302, 166/381, 387, 57, 119; 148/402, 563; 277/334, 277/338, 340, 407, 627, 650
See application file for complete search history.

(56) References Cited

U.S. PATENT DOCUMENTS

| | | | |
|---|---|---|---|
| 1,201,706 | A | 10/1916 | Dodge |
| 2,009,496 | A | 7/1935 | Johnson |
| 2,312,600 | A | 3/1943 | Well Mechanism |
| 2,368,401 | A | 1/1945 | Baker |
| 2,496,402 | A | 2/1950 | McVeigh et al. |
| 2,718,266 | A | 9/1955 | Berry et al. |
| 2,797,756 | A | 7/1957 | Hall, Sr. |
| 2,824,613 | A | 2/1958 | Baker et al. |
| 2,855,052 | A | 10/1958 | Wright et al. |
| 2,962,313 | A | 11/1960 | Conrad |

(Continued)

FOREIGN PATENT DOCUMENTS

| | | | |
|---|---|---|---|
| EP | 1793078 | A1 | 6/2007 |
| GB | 2148985 | A | 6/1985 |

(Continued)

OTHER PUBLICATIONS

PCT/US2008/063097 "International Search Report and Written Opinion", dated Sep. 9, 2008, 14 pages.

(Continued)

*Primary Examiner* — Shane Bomar
*Assistant Examiner* — Catherine Loikith
(74) *Attorney, Agent, or Firm* — MH2 Technology Law Group, LLP

(57) ABSTRACT

A temperature activated actuator installed on a tubular to actuate an adjacent device may include one or more shape-memory alloy elements. The elements may be coupled between a first portion and a second portion of a device, or the elements may be coupled between the tubular and a portion of the device. The elements are activated by raising the temperature to a transition temperature to cause metallurgical phase transformation, causing the elements to shrink and displace at least a portion of the device. The actuator may be used, for example, to actuate a centralizer from a run-in mode to a deployed mode or, alternately, to actuate a packing member from a run-in mode to an isolating mode. A nickel-titanium alloy, for example, may be used as the shape-memory alloy material from which the shape-memory element is made.

7 Claims, 9 Drawing Sheets

U.S. PATENT DOCUMENTS

| | | | | |
|---|---|---|---|---|
| 3,124,196 | A | 3/1964 | Solum | |
| 3,200,884 | A | 8/1965 | Solum et al. | |
| 3,292,708 | A | 12/1966 | Mundt | |
| 3,356,147 | A | 12/1967 | Dreyfuss | |
| 3,563,575 | A | 2/1971 | Sanford | |
| 3,566,965 | A | 3/1971 | Solum | |
| 3,652,138 | A | 3/1972 | Collett | |
| 3,916,998 | A | 11/1975 | Bass, Jr. et al. | |
| 4,269,269 | A | 5/1981 | Wilson | |
| 4,328,839 | A | 5/1982 | Lyons et al. | |
| 4,363,360 | A | 12/1982 | Richey | |
| 4,424,865 | A * | 1/1984 | Payton, Jr. | 166/302 |
| 4,515,213 | A * | 5/1985 | Rogen et al. | 166/123 |
| 4,545,436 | A | 10/1985 | Harrison | |
| 4,641,776 | A | 2/1987 | Vlasek et al. | |
| 4,651,823 | A | 3/1987 | Spikes | |
| 4,688,636 | A | 8/1987 | Hennessey | |
| 4,713,870 | A * | 12/1987 | Szalvay | 29/402.09 |
| 4,787,458 | A | 11/1988 | Langer | |
| 5,199,497 | A * | 4/1993 | Ross | 166/381 |
| 5,238,062 | A | 8/1993 | Reinholdt | |
| 5,261,488 | A | 11/1993 | Gullet et al. | |
| 5,501,281 | A | 3/1996 | White et al. | |
| 5,575,333 | A | 11/1996 | Lirette et al. | |
| 5,706,894 | A | 1/1998 | Hawkins, III | |
| 5,860,760 | A | 1/1999 | Kirk | |
| 5,908,072 | A | 6/1999 | Hawkins | |
| 6,209,638 | B1 | 4/2001 | Mikolajczyk | |
| 6,216,779 | B1 * | 4/2001 | Reinhardt | 166/57 |
| 6,446,717 | B1 * | 9/2002 | White et al. | 166/187 |
| 6,457,519 | B1 | 10/2002 | Buytaert | |
| 6,484,803 | B1 | 11/2002 | Gremillion | |
| 6,679,325 | B2 | 1/2004 | Buytaert | |
| 6,679,335 | B2 | 1/2004 | Slack et al. | |
| 6,725,939 | B2 | 4/2004 | Richard | |
| 6,742,585 | B1 * | 6/2004 | Braithwaite et al. | 166/196 |
| 6,779,602 | B1 * | 8/2004 | Van Bilderbeek et al. | 166/216 |
| 6,871,706 | B2 | 3/2005 | Hennessey | |
| 6,997,254 | B2 | 2/2006 | Jenner | |
| 7,066,252 | B2 * | 6/2006 | Heijnen et al. | 166/227 |
| 7,096,939 | B2 | 8/2006 | Kirk et al. | |
| 7,143,848 | B2 | 12/2006 | Armell | |
| 7,159,619 | B2 | 1/2007 | Latiolais, Jr. et al. | |
| 7,735,567 | B2 * | 6/2010 | O'Mally et al. | 166/387 |
| 7,743,825 | B2 * | 6/2010 | O'Malley et al. | 166/179 |
| 2002/0112853 | A1 | 8/2002 | Buytaert | |
| 2002/0139537 | A1 | 10/2002 | Young et al. | |
| 2002/0139538 | A1 | 10/2002 | Young et al. | |
| 2003/0000607 | A1 | 1/2003 | Jenner | |
| 2003/0230411 | A1 | 12/2003 | Richard | |
| 2004/0194970 | A1 * | 10/2004 | Eatwell et al. | 166/387 |
| 2006/0278388 | A1 * | 12/2006 | Zanca et al. | 166/242.6 |
| 2007/0227775 | A1 | 10/2007 | Ma et al. | |
| 2007/0235199 | A1 | 10/2007 | Logiudice | |
| 2008/0035331 | A1 | 2/2008 | Buytaert | |
| 2008/0115972 | A1 | 5/2008 | Lynde et al. | |
| 2008/0283237 | A1 | 11/2008 | Buytaert et al. | |

FOREIGN PATENT DOCUMENTS

| | | | |
|---|---|---|---|
| GB | 2403238 | A | 12/2004 |
| WO | WO9108374 | | 6/1991 |
| WO | WO9964714 | A | 12/1999 |
| WO | WO2005107395 | | 11/2005 |

OTHER PUBLICATIONS

PCT/US2008/063163 "International Search Report and Written Opinion", dated Nov. 28, 2008, 19 pages.

PCT/US2008/068891 "International Search Report and Written Opinion", dated Sep. 29, 2008, 11 pages.

U.S. Appl. No. 11/749,544, filed May 16, 2007 "Low Clearance Centralizer and Method of Making Centralizer".

U.S. Appl. No. 11/828,943, filed Jul. 26, 2007 "Apparatus for and Method of Deploying a Centralizer Installed on an Expandable Casing String".

U.S. Appl. No. 12/042,989, filed Mar. 5, 2008 "Expandable Centralizer for Expandable Pipe String".

U.S. Appl. No. 12/136,948, filed Jun. 11, 2008 "Modular Low-Clearance Centralizer and method of Making Modular Low-Clearance Centralizer".

U.S. Appl. No. 12/543,349, filed Aug. 18, 2009 "Method of and Kit for Installing a Centralizer on a Pipe Segment".

Focus on New Technology Fall 2007, p. 3.

Frank's Anaconda Stop Collar Sheet, Frank's Casing Crew & Rental Tools, Inc., Lafayette, LA, 2003.

PCT/US2009/058886 "PCT—Invitation to Pay Additional Fees", mailing date Dec. 7, 2010, PCT Application No. PCT/US2009/058886 filed on Sep. 29, 2009, Frank's International, Inc., 6 pages.

* cited by examiner

DOWNHOLE DEVICE ACTUATOR AND METHOD

STATEMENT OF RELATED APPLICATIONS

This application depends from and claims priority to U.S. Provisional Application No. 61/101,100 filed on Sep. 29, 2008. This application also depends from and claims priority to U.S. Provisional Application No. 61/239,195 filed on Sep. 2, 2009.

FIELD OF THE INVENTION

This application relates to methods and devices for downhole operations in earthen boreholes. More specifically, this application relates to an actuator for actuating a device after it is coupled to a tubular and run into an earthen borehole.

BACKGROUND

It is conventional practice to drill an earthen borehole into the earth using a tubular string, typically called a drill string, extending from a rig at the earth's surface, and to cement a tubular string, typically called a casing string, in the borehole to prevent collapse and to stabilize the borehole. Some boreholes may be extended in a step-wise manner, e.g., with additional strings of casing cemented in the borehole as part of each step. Another tubular may be installed within the bore of the cemented casing string to facilitate, for example, the recovery of oil and/or gas from penetrated geologic formations.

Various actuatable devices may be coupled to a tubular and later actuated downhole to facilitate operations. For example, but not by way of limitation, bow spring centralizers may be used to position a casing string within a borehole, e.g., in a desired location therein, for the subsequent cementing step. Bow spring centralizers may be coupled to, e.g., disposed on, a casing at axially spaced intervals to provide an annulus between the casing and the borehole. Cement slurry may be displaced through the bore of the casing and into the annulus to form a protective liner. In boreholes having horizontal or highly deviated portions, more robust bow springs may be used to provide sufficient stand-off, but more robust bow springs may increase frictional resistance to movement of the casing through the borehole. It should be understood that more robust bow springs will more forcibly engage the wall of the bore in which the centralizer is disposed, and that the friction to movement of the tubular string is determined, at least in part, by the force of engagement of the bow springs with the wall of the bore.

One solution is to couple bow spring centralizers to the casing in a collapsed, e.g., retracted stand-off element(s), mode to reduce the frictional running resistance. The casing may be positioned in the borehole and the centralizers may then be deployed at the targeted interval to provide the desired stand-off. The centralizers are generally inaccessible because they are disposed within an annulus between the casing and the borehole. As a result, activating centralizers from a collapsed mode to the expanded mode, without compromising the integrity of the casing, presents a challenge.

One attempted solution provides a method of restraining a centralizer installed on a casing in a collapsed mode using one or more dissolvable restraining bands, and then dissolving the bands downhole using a strong acid, such as fluoric acid, circulated into the annulus. This solution is disfavored because the acid is dangerous to handle at the surface and can damage critical components in the borehole.

Another example of a device to be actuated after being positioned in a borehole is a packer. A packer may be used to seal an annulus between two tubulars such as, for example, an annulus between an installed casing and a production tubular disposed within the bore of the casing. The pressure in the annulus may be monitored so that a leak in the casing and/or production tubular can be readily detected, e.g., for diagnoses and/or repair. A packer may be coupled to a tubular string and run into a borehole in a retracted mode and then expanded to an isolating mode downhole. As above, a challenge is presented in actuating the packer from the retracted mode to the isolating mode without compromising the integrity of the tubular.

What is needed is an actuator that can be disposed on a tubular adjacent to an actuatable device, run into a borehole and reliably activated to actuate the device downhole without compromising the integrity of the tubular on which it is installed.

SUMMARY

Embodiments of the temperature activated actuator disclosed herein satisfy the above-stated needs. Embodiments of the temperature activated actuator utilize one or more shape-memory alloy elements to provide an actuator that can be installed on a tubular, e.g., adjacent to an actuatable device, run into a borehole in a run-in mode and there activated to actuate the actuatable device within a targeted interval of the borehole. The manipulation may include deployment, expansion, opening, closing and/or energizing of the adjacent device. The device may be actuated by control of the temperature to which the one or more shape-memory alloy elements of the actuator is exposed. For example, raising the temperature of one or more shape-memory alloy elements within an embodiment of the temperature activated actuator can cause elongate shape-memory elements to contract to forcibly displace one or more components of an adjacent actuatable device and to thereby actuate the device. In this manner, a temperature activated actuator may be used to, for example, but not by way of limitation, deploy a bow spring centralizer, to expand a packer, to expand a cement basket to isolate a portion of an annulus for cementing, or to open or close a fluid port in a valve.

A shape-memory alloy of the kind that can be used in embodiments of the temperature activated actuator is a material that "remembers" its shape, and can be returned to that shape after being deformed by applying heat to the alloy. For example, the shape memory effect may result from metallurgical phase transformation from martensite to austenite when heated, and from austensite to martensite upon cooling. The shape-memory element may have a first configuration at a first temperature (e.g., within a first range of temperatures) and may be mechanically worked, to assume a second configuration while at the first temperature (or while within the first range of temperatures). The shape-memory element may be coupled, in its second configuration, to a packer, such as one having an expandable packing member or an elastomeric packing member, to form a temperature activated packer, and then disposed within a bore, such as a bore of a casing. Heating of the one or more shape-memory elements of the actuator to a transition temperature restores, partially or fully, the shape-memory element to or towards the first configuration. A device adjacent to the actuator may be actuated through an application of force provided by the shape-memory element upon restoration towards its first configuration.

The shape-memory element may, in one embodiment, be substantially elongate so that restoration from the second configuration towards the first configuration causes the shape-memory element to shrink (e.g., contract) in length. By coupling the shape-memory element to at least one component or portion of the adjacent actuatable device, the contraction (e.g., shrinkage) can provide an amount of work to actuate the device; that is, the contraction can apply a force to the device over a displacement generally corresponding to the amount of contraction (e.g., shrinkage). The work produced by the actuator may be used to, for example, axially compress and thus radially expand a packer such as, for example, one having an elastomeric sleeve-shaped packing member, or to axially adduct a first end collar of a centralizer toward a second end collar to forcibly deploy, (e.g., radially extend or bend) bow springs coupled between the first and second collars.

In some embodiments, the temperature activated actuator may comprise a stand-alone apparatus adjacent and coupled to one or more components or portions of the actuatable device. This device may then be disposed on the tubular and run into the borehole to later be actuated by the actuator. In other embodiments, the temperature activated actuator may be integrated with or within the device to be actuated downhole. In some integrated embodiments, the shape-memory elements may be coupled to conventional structural components or portions of the actuatable device. For example, in one embodiment of the stand-alone actuator, the temperature activated actuator may be installed on a tubular adjacent to and abutting, for example, a bow spring centralizer. The shape-memory elements of the actuator may, for example, be coupled to one or to both of the end collars of the centralizer. Contraction of the shape-memory elements may forcibly displace one or both end collars of the bow spring centralizer to expand the centralizer by deploying the bow springs.

It should be understood that embodiments of the temperature activated actuator may be used in conjunction with other actuatable downhole devices. These devices can be adapted to respond to forcible displacement of one component or portion of the device, and thereby move, expand, displace, etc. another component or portion of the device. In one embodiment, the actuatable device may be a bow spring centralizer that responds to adduction of the end collars to radially expand by deploying the bow springs coupled between the end collars. In another embodiment, the actuatable device may be a packer that responds to adduction of the end collars to expand a packing member, or one that responds to constriction of a first portion to expand a second portion.

It should be understood that a shape-memory element may be fashioned into a variety of shapes or configurations, coupled to a actuatable device or installed on a tubular adjacent to a actuatable device, disposed in a borehole on a tubular and heated to activate the actuator and actuate the device within the borehole.

The activation of the temperature activated actuator to an activated configuration may be, in one embodiment, by exposure of the shape-memory elements of the actuator to geothermal heat of the geologic formation(s), e.g., that adjacent to which the actuator is disposed. For example, for a thermal gradient of 27.3° C. per 1000 m (15° F. per 1000 ft) of vertical depth, and an ambient temperature of 27° C. (80° F.), a vertical depth of about 4,050 m (about 13,300 ft) may elevate the temperature of an embodiment of a shape-memory element to a transition temperature of about 138° C. (280° F.) to activate the alloy, i.e. to cause the shape-memory element to change its physical configuration. It should be understood that geothermal gradients may vary, and that the transition temperatures of shape-memory alloys, for example, the alloys listed below, may vary according to the chemical composition of the shape-memory alloy. Accordingly, one may select a shape-memory alloy element that can be advantageously deployed at targeted depths corresponding to the anticipated transition temperature of the selected alloy.

Alternately or additionally, the temperature activated actuator may be activated by application of electrical resistance heating. For example, but not by way of limitation, a battery, fuel cell or other source of electrical current may be disposed within, functionally connected to, or proximate the actuator to provide electrical current to one or more resistors, e.g., disposed proximate to one or more shape-memory elements. In one embodiment, the one or more shape-memory elements themselves may serve as the electrical resistors. The heat generated as a result of the current applied across the electrical resistors may heat the shape-memory element to the transition temperature, e.g., causing it to contract and actuate the actuatable device.

It should also be understood that, during installation of the tubular, the actuator and the adjacent device to the targeted interval of the borehole, it may be desirable to maintain the shape-memory element at a temperature below the transition temperature until the tubular, the actuator and the adjacent device are positioned within the targeted interval. In one embodiment of a method for use in a vertically deep well, a cooling fluid may be pumped down a tubular to the actuator to maintain the temperature of the shape-memory element below the transition temperature during run-in of the tubular to the targeted interval. The supply of cooling fluid may be discontinued when the tubular is at the targeted interval to allow heating of the shape-memory elements to activate the actuator. Additionally or alternatively, to retract and remove a device, a cooling fluid may be supplied, e.g., from a tubular, to cool the shape-memory element of the actuator to a second transition temperature at which the contracted shape-memory element will relax or re-elongate and retract the device from its deployed configuration.

Factors to be considered in the design of an embodiment of the temperature activated actuator include the amount of force needed to actuate the actuatable downhole device. For example, where the downhole device is a bow spring centralizer, the rigidity of the bow springs, the amount of radial expansion, the weight of the tubular (and contents) and/or the inclination of the borehole are among the factors that may determine the force required to adduct the end collars of the centralizer one toward the other to deploy the bow springs. Similarly, where the downhole device is a packer having a packing member to be radially expanded through application of axial force by one or more shape-memory elements, the size, thickness and/or compressibility of the packing member may determine the force required to expand the packing member to engage the wall of a bore. In some embodiments of the temperature activated actuator, multiple shape-memory elements may be used to multiply the force that can be imparted by the actuator to, for example, but not by way of limitation, deploy the bow springs of a centralizer or expand the packing member of a packer. For example, where increased force is needed to adequately expand a centralizer or a packer or other device, multiple elongate shape-memory elements may be coupled to one or more collars of the device, the actuator disposed within a bore, and the multiple shape-memory elements may be together heated to a transition temperature to contract the multiple shape-memory elements to or towards a first configuration.

In one embodiment, multiple shape-memory elements may be angularly distributed about an axis of the temperature activated actuator. For example, for an actuator adapted for being installed on a tubular having an axis, four shape-memory elements may be angularly distributed at about 90 degree intervals about the axis to together generate a distributed collective force to displace a collar to which the four shape-memory elements are together coupled. In an alternate embodiment, multiple shape-memory elements may be concentrated in clusters. For example, a pair of immediately adjacent shape-memory elements may be disposed within the temperature activated actuator about 180 degrees, or generally opposite, from a second pair of immediately adjacent shape-memory elements. It should be understood that a variety of arrangements may be used to position shape-memory elements in embodiments of the temperature activated actuator, and many of these arrangements may include a general balancing of the forces applied by multiple shape-memory elements to provide an evenly distributed displacing force.

Additionally or alternatively to using a plurality of shape-memory elements, the shape-memory element(s) of a temperature activated actuator may be strategically arranged to magnify the displacement obtainable. For example, but not by way of limitation, in an application of a shape-memory element to actuate a downhole device, one or more elongate shape-memory elements may be coupled between axially aligned collars with the device disposed generally intermediate the aligned collars. The one or more shape-memory elements may be activated by heating to a transition temperature to adduct the collars one toward the other to actuate the device there between.

An arrangement that may be utilized to magnify the displacement obtainable from the contraction of shape-memory elements of a given length includes coupling a plurality of shape-memory elements in opposed relationships one to the other(s) so that a displacement by a first set of shape-memory elements may be aggregated with a displacement by a second set of shape-memory elements to provide a magnified collective displacement imparted to the actuatable device. A "set," as that term is used herein, refers to shape-memory elements that are similarly situated or similarly coupled, and may include a single shape-memory element.

Metal alloys having a variety of chemical compositions may be used to make the shape-memory elements to be used in embodiments of the temperature activated actuator including, for example, but not limited to, alloys comprising: silver-cadmium, gold-cadmium, copper-aluminum-nickel, copper-tin, copper-zinc, copper-zinc-silicon, copper-zinc-aluminum, copper-zinc-tin, iron-platinum, manganese-copper, iron-manganese-silicon, platinum alloys, cobalt-nickel-aluminum, cobalt-nickel-gallium, nickel-iron-gallium, and titanium-palladium alloys. nickel-titanium alloys, also known as Nitinol alloys. It should be understood that various alloy(s) and various chemical compositions of alloy(s) may enable the customization of the transition temperature and other performance characteristics of the temperature activated actuator.

In another embodiment of the temperature activated actuator, at least some of the work required to actuate the actuatable device, e.g., from a first configuration to a second configuration, may be stored within a spring, fluidic cylinder, or other energy storage device. In some embodiments, the spring, fluidic cylinder, or energy storage device may comprise components of the actuatable device. For example, a bow spring centralizer may be collapsed to a first configuration by rotation of a first end collar relative to the second end collar to deform the bow springs there between to a generally collapsed configuration. The bow spring centralizer may then be restrained in the collapsed configuration to facilitate actuation and release of the centralizer to expand, using energy stored within the bow springs, to a deployed configuration. A temperature activated actuator having a shape-memory element may be used to secure a bow spring centralizer in the collapsed configuration until the temperature of the shape-memory element is raised to a transition temperature activating the shape-memory element and actuating the bow spring centralizer from the collapsed configuration to the deployed configuration. In this embodiment, the temperature activated actuator is integral with the actuatable device insofar as the energy used to expand the actuatable device may be stored, in whole or in part, in one or more components of the device as opposed to being generated solely by the shape-memory element component of the temperature activated actuator. For example, but not by way of limitation, at least a portion of the energy needed to deploy a centralizer from a collapsed mode to an expanded mode may be, in some embodiments, stored within the bow springs of the centralizer, and the centralizer may be restrained in a collapsed mode against substantial bias urging the bow springs to the deployed mode. An actuator may be used to release the centralizer from the restrained and collapsed mode and, in some embodiments, the actuator may also be used to displace one or more components of the centralizer to further deploy the bow springs.

In one embodiment, a heat source may be used to raise the temperature of the shape-memory element to a transition temperature to activate, or "trigger," the actuator. Upon activation by the heat source, the temperature activated actuator may actuate an actuatable device functionally connected to the actuator using the stored energy provided from the contraction of the shape-memory element and/or from an energy storage device, such as a spring. In another embodiment, a heat sink, such as a cooling system, may be used to prevent or delay activation of the temperature activated actuator, e.g., as the device is positioned within a targeted interval of a borehole at a vertical depth having a naturally occurring temperature that would, but for the heat sink, raise the temperature of the shape-memory element(s) and activate the actuator to actuate the actuatable device. Upon positioning the actuatable device at the targeted interval, cooling of the shape-memory element(s) may be terminated and the temperature of the shape-memory element(s) is permitted to increase, as heated by geothermal heat, to a transition temperature at which the shape-memory element(s) shrinks to actuate the adjacent device. It should be understood that, in alternate embodiments, a shape-memory element may be expanded by cooling to a transition temperature at which the shape-memory element may extend due to metallurgical phase transformation, and such expansion may similarly be used to affect actuation of an actuatable device.

In one embodiment, a temperature activated actuator and/or the adjacent actuatable device may be protected from unwanted engagement with the borehole by a rigid rib centralizer (or centralizers) coupled to the tubular adjacent to the actuator and/or the device. For example, in one embodiment, an actuator and an adjacent actuatable device are protected from unwanted contact with the borehole by straddling both with a pair of rigid rib centralizers to provide sufficient standoff between the tubular and the borehole to reduce or prevent unwanted contact between the actuator and the borehole. It should be understood that the actuator may be more exposed to engagement with the borehole in curved or irregular sections of the borehole.

An embodiment of a method of using an actuator to actuate a downhole device coupled to a tubular and run into a borehole includes the steps of: receiving an actuatable device on a tubular; receiving a temperature activated actuator, comprising one or more elongate shape-memory elements coupled at a first end to a first collar and at a second end to at least one of the tubular and a second collar, on the tubular adjacent the actuatable device; making-up the tubular into a tubular string; running the tubular string into a borehole; raising the temperature of the one or more shape-memory elements to a transition temperature; displacing the at least one of the first or second collars relative to the other of the first and second collars; and actuating the adjacent device. In one embodiment of the method, the step of raising the temperature may include passing a current through a resistor proximate the one or more shape-memory elements. In another embodiment of this method, the step of actuating the adjacent device may comprise either deploying a bow spring or axially compressing a packing element.

Another embodiment of the method to actuate a device on a tubular run into a borehole comprises the steps of: receiving an actuatable device on a tubular; receiving a temperature activated actuator, comprising one or more elongate shape-memory elements coupled at a first end to a first collar and at a second end to at least one of the tubular and a second collar, on the tubular adjacent the actuatable device; making-up the tubular into a tubular string; running the tubular string into a borehole to a vertical depth sufficient to raise the temperature of the one or more shape-memory elements to a transition temperature; displacing at least one of the first or second collars relative to the other of the first and second collars; and actuating the adjacent device.

BRIEF DESCRIPTION OF THE DRAWINGS

The foregoing and other features and aspects will be best understood with reference to the following detailed description of embodiments of the invention, when read in conjunction with the accompanying drawings, wherein.

DETAILED DESCRIPTION

Figure 1:
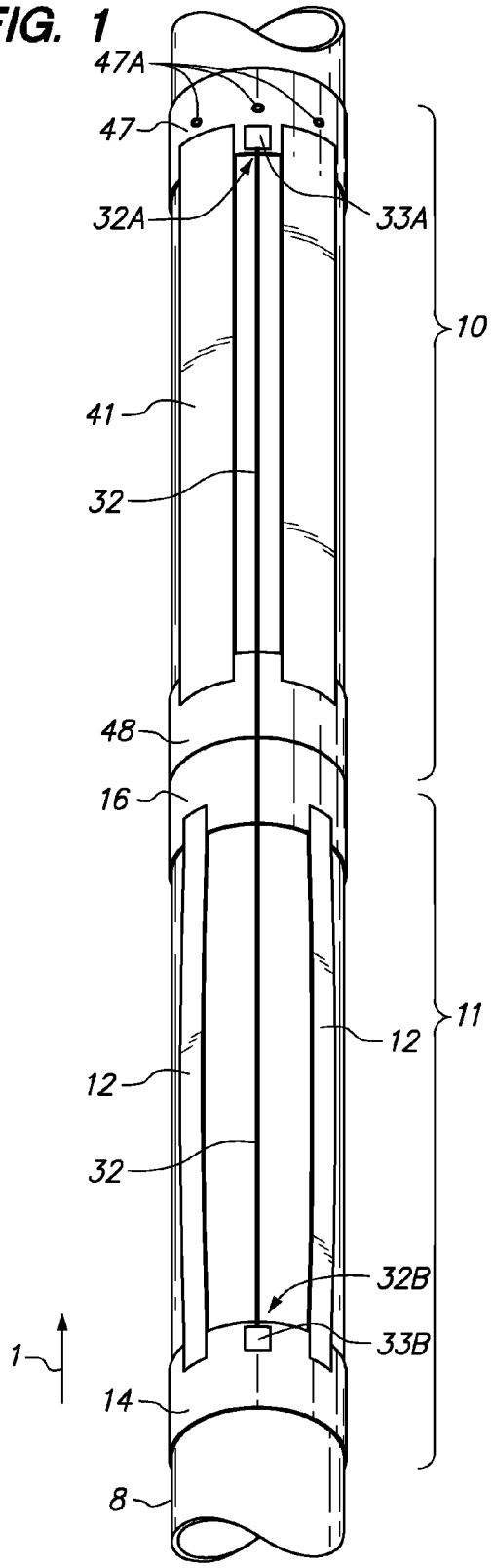
FIG. 1 is a perspective view of an embodiment of a temperature activated actuator coupled to a tubular in a run-in mode and adjacent to a centralizer having radially expandable ribs.

The following detailed description refers to the above-listed drawings wherein depicted elements are not necessarily shown to scale and wherein like or similar elements are designated by the same reference numeral through the several views.

FIG. 1 is a perspective view of an embodiment of a temperature activated actuator 10 received on a tubular 8 in a run-in mode and proximate, e.g., abutting, a centralizer 11 having radially expandable ribs 12. The actuator 10 illustrated in FIG. 1 comprises a first collar 47 having a plurality of set screws 47A threadedly received therein to couple the first collar 47 to the tubular 8, a second collar 48 axially spaced apart from the first collar 47 and a plurality of spacers 41 extending there between to maintain the first and second collars 47 and 48 in their spaced-apart relationship. The depicted actuator 10 further comprises an elongate shape-memory element 32, in a first configuration, coupled at a first end 32A to the first collar 47 (the coupling is hidden by optional cover 33A) and at a second end 32B to a first collar 14 (the coupling is hidden by optional cover 33B) of the centralizer 11. The centralizer 11 further comprises a second collar 16 abutting the second collar 48 of the actuator 10 and axially spaced apart from the first collar 14 of the centralizer 11. The centralizer 11 further comprises a plurality of bow springs 12 extending there between. The bow springs 12 illustrated in FIG. 1 are slightly bowed to ensure flexible bending, radially outwardly, of the bow springs 12 upon adduction of the first collar 14 in the direction of the arrow 1 toward the second collar 16 upon actuation of the centralizer 11 by the actuator 10. Actuator 10 may be activated by raising the temperature of the shape-memory element 32 to a transition temperature at which the shape-memory element 32 contracts to a second configuration and actuates the abutting centralizer 11.

It should be understood that the temperature activated actuator and/or the actuatable device may be secured in place on the tubular 8. For example, but not by way of limitation, the second collar 48 could comprise a plurality of set screws to secure the second collar in its position on the tubular 8 instead of, or in addition to, the first collar 47 being secured in its position on the tubular 8. Alternately, either the first collar 14 or the second collar 16 could be secured in place on the tubular 8. For example, but not by way of limitation, the first collar 14 of the centralizer 11 may be secured to the tubular 8 using set screws (not shown in FIG. 1) and the temperature activated actuator 10 could be movable, upon activation of the actuator 10, against the second collar 16 to displace the second collar 16 toward the first collar 14 and thereby actuate the centralizer 11. Alternately, the second collar 16 may be secured to the tubular 8 so that, upon activation of the actuator 10, the first collar 14 moves toward the second collar 16. It should be understood that, in this latter embodiment, the temperature activated actuator 10 could be secured using set screws in one or both collars, or it could be secured adjacent the centralizer by the one or more shape-memory elements coupled to the centralizer. It should also be understood that the second collar 48 of the actuator 10 and the second collar 16 of the centralizer need not be in an abutting relationship, as illustrated in FIG. 1, since set screws, adhesives or stop collars, or combinations thereof, can be used to secure at least a component of one or both of the centralizer 11 and the actuator 10 in a position on the tubular 8. It should be further understood that either of the first collar and the second collar may comprise a portion of, or may be coupled to, another device that is received on or coupled to the tubular including, but not limited to, a stop collar, a stabilizer, a rigid rib stop collar, a gauge ring, etc.

Figure 2:
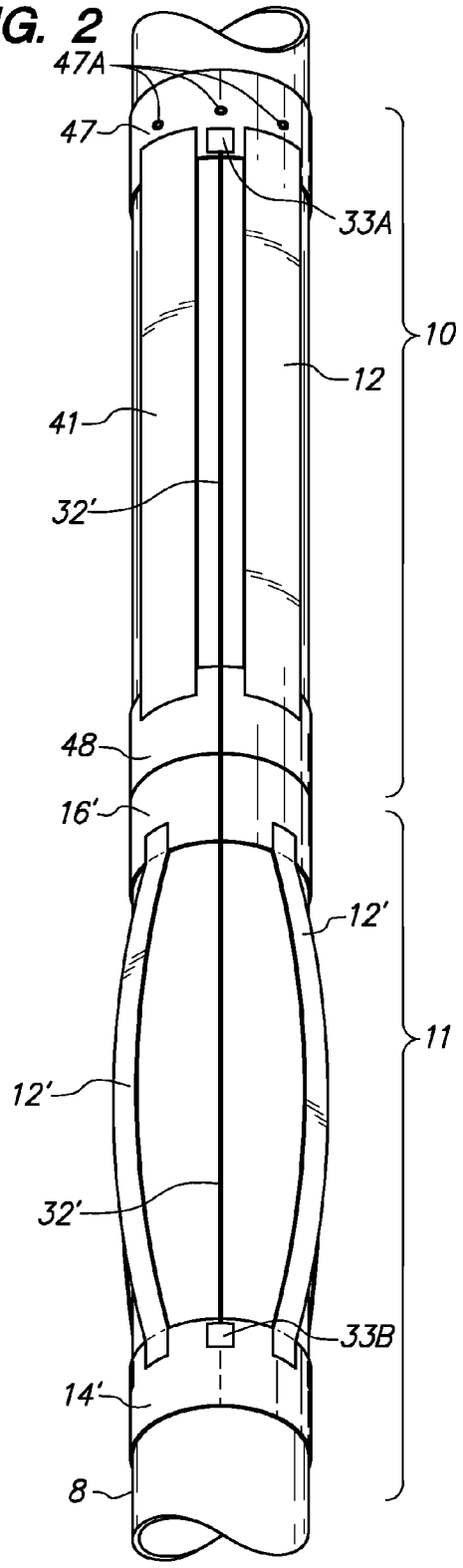
FIG. 2 is a perspective view of the actuator and centralizer of FIG. 1 in an activated and expanded mode, respectively, to provide stand-off between the tubular and a bore in which the tubular may be disposed.

FIG. 2 is a perspective view of the actuator and centralizer of FIG. 1 in an actuated and expanded mode, respectively. The shape-memory element 32' is illustrated in FIG. 2 after contracting in length to forcibly displace the first collar 14' of the centralizer 11 toward the first collar 47 of the actuator 10 to adduct (e.g., to at least partially close the distance separating) the first and second collars 14' and 16 to bow and radially deploy the ribs 12'. The actuator 10 and the centralizer 11 are illustrated in FIGS. 1 and 2 in a condition removed from a borehole to better reveal the various components.

Figure 3:
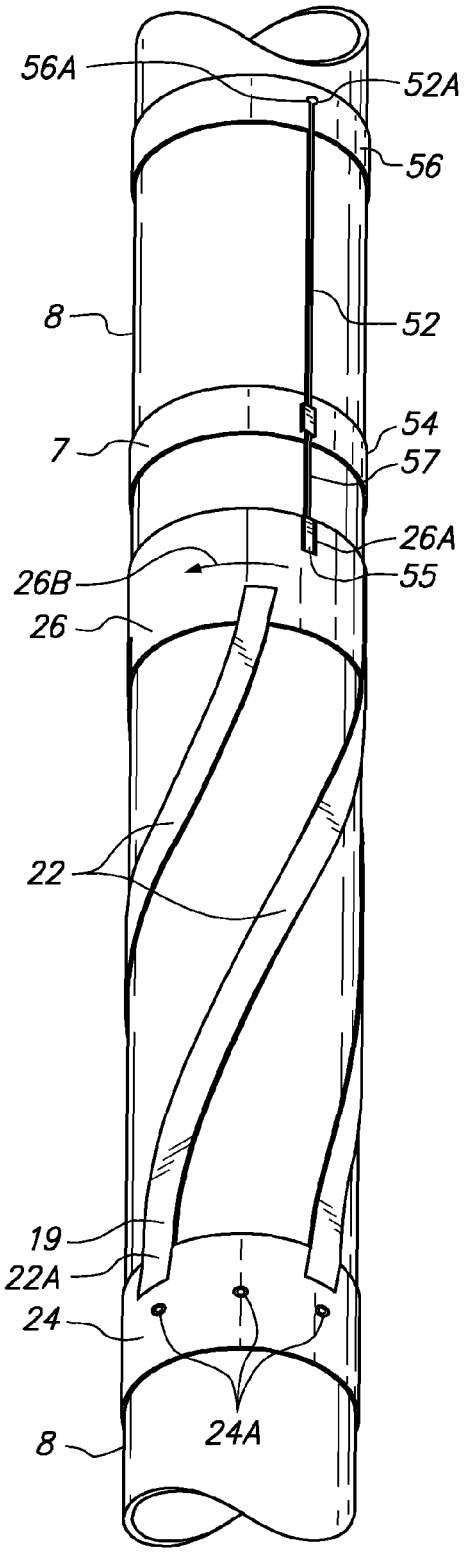
FIG. 3 is a perspective view of an alternate embodiment of a temperature activated actuator coupled to a tubular in a run-in mode and adjacent to a centralizer having radially expandable ribs.

FIG. 3 is a perspective view of an alternate embodiment of a temperature activated actuator 7 installed on a tubular 8 and coupled to a centralizer 19 having a plurality of radially expandable ribs 22 in a collapsed mode. The ribs 22 are coupled at a first end 22A to a first collar 24 threadedly receiving a plurality of set screws 24A and at a second end 22B to a second collar 26 having a notch 26A to receive a dog 55 coupled to the second end 57 of a shape-memory element 52. The set screws 24A of the first collar 24 are rotated to engage and "bite" into the surface of the tubular 8 to secure the first collar 24 to the tubular 8. The ribs 22 of the centralizer 19 may be at least partially elastically collapsed to the generally spiral configuration illustrated in FIG. 3 by forcible rotation of the second collar 26 about the tubular 8 in a direction opposite to the arrow 26B to store energy in the ribs 22. The actuator 7 comprises the shape-memory element 52, in a first configuration, coupled at a first end 52A to a stop collar 56 received on the tubular 8 and movably coupled adjacent a second end 57 to a guide collar 54 received on or coupled to the tubular 8 in a spaced-apart relationship to the first collar 56. The guide collar 54 slidably engages a portion of the shape-memory element 52 to permit positioning of the shape-memory element 52 and the dog 55 coupled to the second end 57 of the shape-memory element 52 without impairing or preventing contraction of the shape-memory element 52 upon activation of the actuator 7. The dog 55 coupled to the second end 57 of the shape-memory alloy element 52 is removably received into the notch 26A to retain the second collar 26 in its rotated position relative to the first collar 24 and to retain the ribs 22 in the spiral configuration. The actuator 7 of FIG. 3 further comprises the ribs 22 of the centralizer 22 insofar as the ribs 22 are retained in the collapsed configuration to store, and later released from the collapsed configuration (as discussed below in connection to FIG. 4) to surrender, energy to displace the centralizer 22 from a collapsed mode illustrated in FIG. 3 to a deployed mode illustrated in FIG. 4. The temperature of the shape-memory element 52 may be raised to a transition temperature at which the shape-memory element 52 contracts to withdraw the dog 55 from the notch 26A and release the second collar 26 to rotate about the tubular 8 in the direction indicated by arrow 26B.

It should be understood that alternate structures may be used to restrain the centralizer 19 in the collapsed mode and to release it to the deployed mode. For example, but not by way of limitation, a dog protruding from the collar 26 could be releasably received into a slot formed on the second end 57 of the shape-memory element 52. As another example, a pin can be coupled to a shape memory element and withdrawn from a collar retainer upon contraction of a shape-memory element or, as another example, a hook can be withdrawn from a loop using contraction of a shape-memory element. As another example, a sacrificial linkage could be used to couple the shape-memory element to the centralizer to release the centralizer upon sacrificial failure of the linkage upon contraction of the shape memory element. A variety of linkage may be devised and coupled to the shape-memory element to accomplish the intended purpose.

Figure 4:
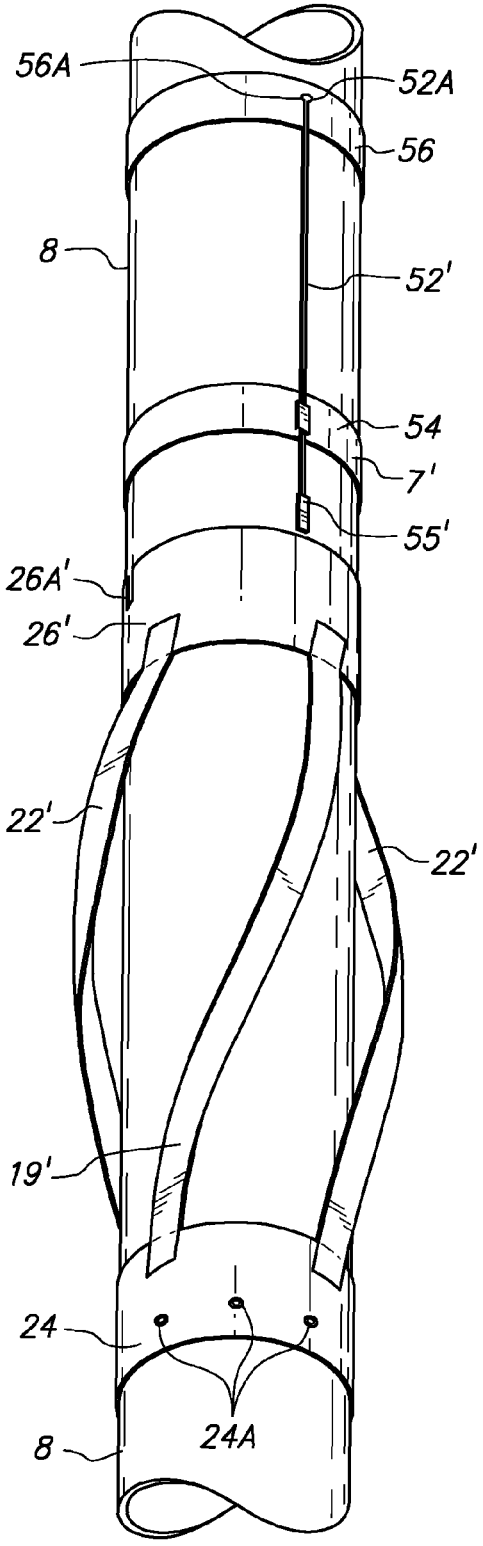
FIG. 4 is the actuator and centralizer of FIG. 3 in an activated and expanded mode, respectively, to provide stand-off between the tubular and a bore in which the tubular may be disposed.

FIG. 4 is the actuator 7' and centralizer 19' of FIG. 3 in an activated mode after the temperature of the shape-memory element 52' is raised to the transition temperature and the shape-memory element 52' contracts in length to withdraw the dog 55' from the notch 26A' of the second collar 26. Upon disengagement from the dog 55', the first collar 26' rotates about the tubular 8 in the direction of the arrow 26B as indicated by the repositioned notch 26A' and the ribs 22' extend to the deployed mode.

Figure 5:
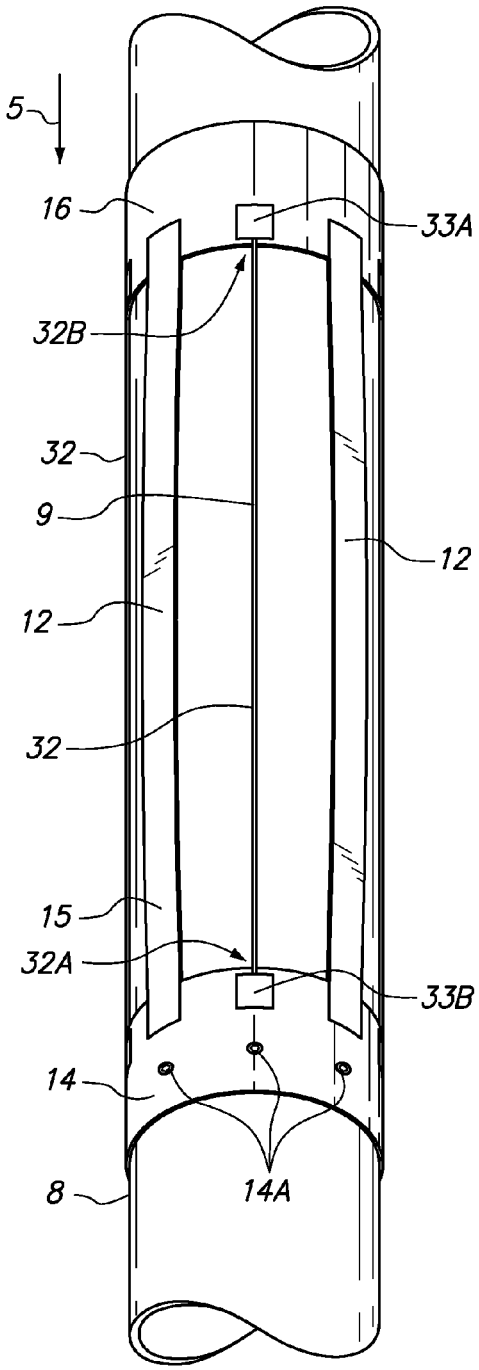
FIG. 5 is a perspective view of a temperature activated actuator coupled between the first and second end collars of a bow spring centralizer installed on a tubular in a run-in mode.

FIG. 5 is a perspective view of an alternate embodiment of a temperature activated actuator 9 coupled between a first end collar 14, threadedly receiving a plurality of set screws 14A rotatable to engage and "bite" into the tubular 8, and the second end collar 16 of a centralizer 15. The actuator 9 comprises one or more shape-memory elements 32, in a first configuration, having a first end 32A coupled to first collar 14 and a second end 32B coupled to a second collar 16 of the centralizer 15 in a spaced relationship to the first collar 14. The centralizer 15 further comprises a plurality of ribs 12 coupled intermediate the first collar 14 and the second collar 16. The temperature of the one or more shape-memory elements 32 may be raised to a transition temperature to shrink the shape-memory elements 32 and displace the second collar 16 in the direction of arrow 5 and toward the first collar 14 to radially expand the ribs 12 there between. It should be understood that, in lieu of set screws, a collar may be secured, e.g., axially and/or rotationally, in a position on a tubular, for example, but not limited to, using an adhesive and/or by frictional engagement.

Figure 6:
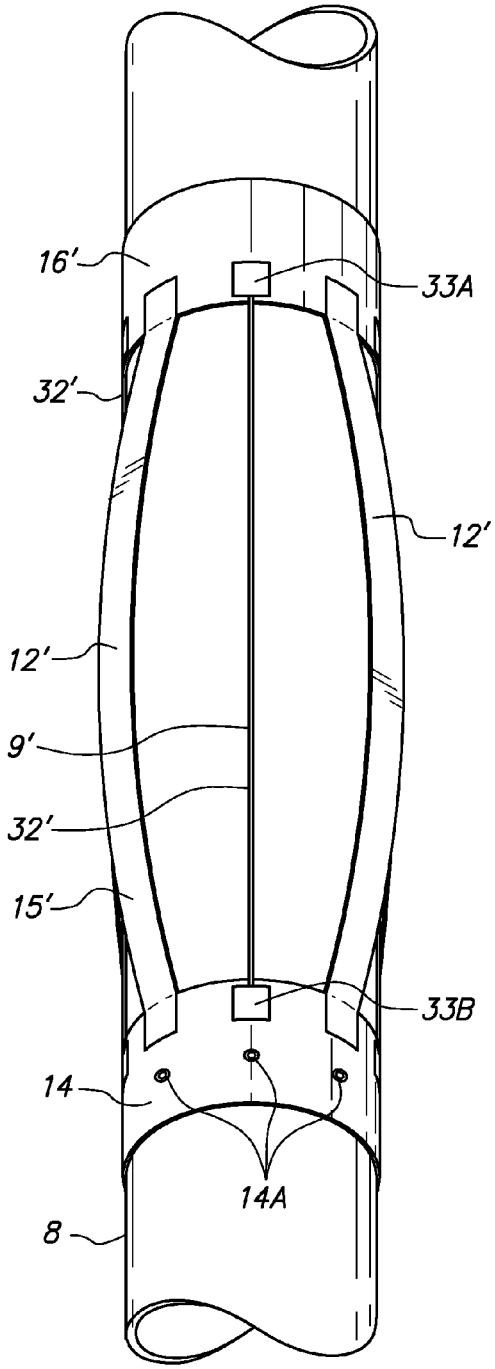
FIG. 6 is the perspective view of the actuator and centralizer of FIG. 6 in an activated and expanded mode, respectively, to provide stand-off between the tubular and a bore in which the tubular may be disposed.

FIG. 6 is the perspective view of the actuator 9' and the centralizer 15 of FIG. 6 in an activated and expanded mode, respectively, to deploy the ribs 12' of the centralizer 15'. The shrink-memory element 32' is illustrated in a contracted or shrunk mode having displaced the second collar 16 toward the first collar 14 which is secured to the tubular 8 by the plurality of set screws 14A. The resulting adduction of the first collar 14 and second collar 16 causes the bow springs 12' to bow radially outwardly to the deployed mode illustrated in FIG. 6.

Figure 7:
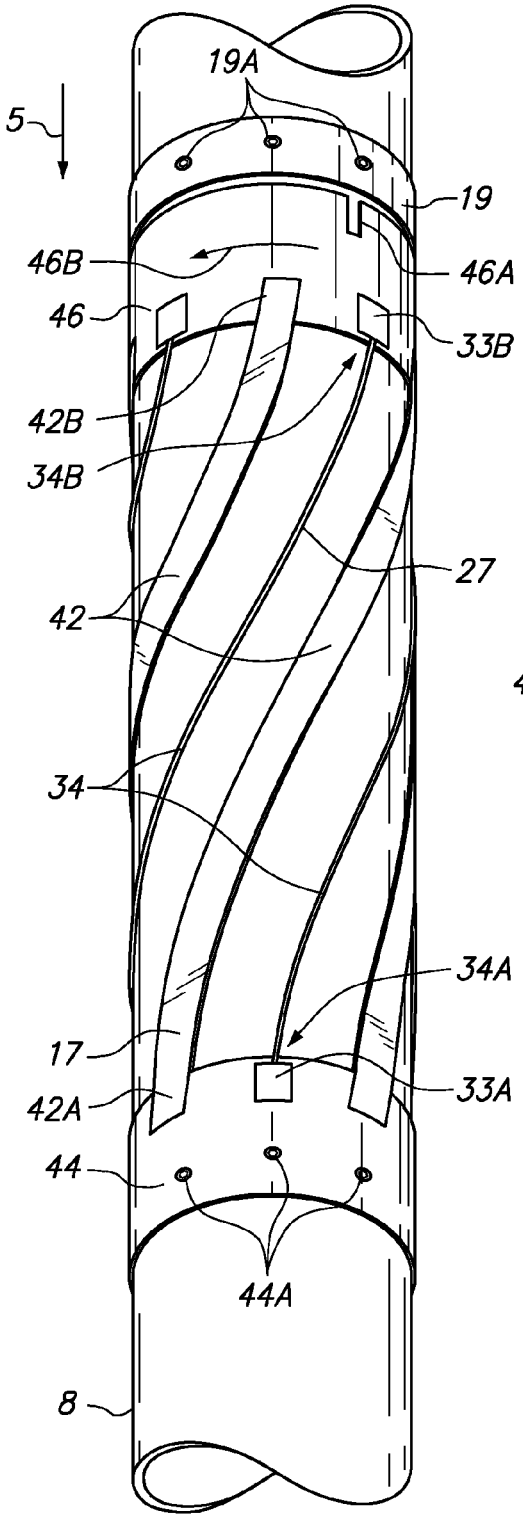
FIG. 7 is a perspective view of a temperature activated actuator coupled between the first and second end collars of an embodiment of a bow spring centralizer installed on a tubular in a run-in mode.

FIG. 7 is a perspective view of an alternate embodiment of a temperature activated actuator 27 coupled between the first end collar 44 and the second end collar 46 of an alternative embodiment of a centralizer 17. The depicted actuator 27 comprises a plurality of shape-memory elements 34, in a first configuration, (although one or more shape-memory elements 34 can be used) coupled at a first end 34A to a first collar 44 and at a second end 34B to a second collar 46 and having a generally non-linear (e.g., spiral or helical) path about the tubular 8 there between. The illustrated centralizer 17 comprises a plurality of generally flexible ribs 42 coupled at a first end 42A to a first collar 44 and at a second end 42B to a second collar 46 having a notch 46A included only for purposes of indicating rotation on the tubular 8, as will be discussed below. The ribs 42 of FIG. 7 may be in a generally relaxed configuration in their spiral-wound configuration, unlike those illustrated in the embodiment of the centralizer of FIGS. 3 and 4 (which are forcibly displaced to the spiral-wound configuration to store energy therein). The temperature of the shape-memory elements 34 may be raised to a transition temperature to contract the shape-memory elements 34 in length to actuate the centralizer 17 to the expanded mode by forcible rotation of the second collar 46 in the direction of the arrow 46B.

Figure 8:
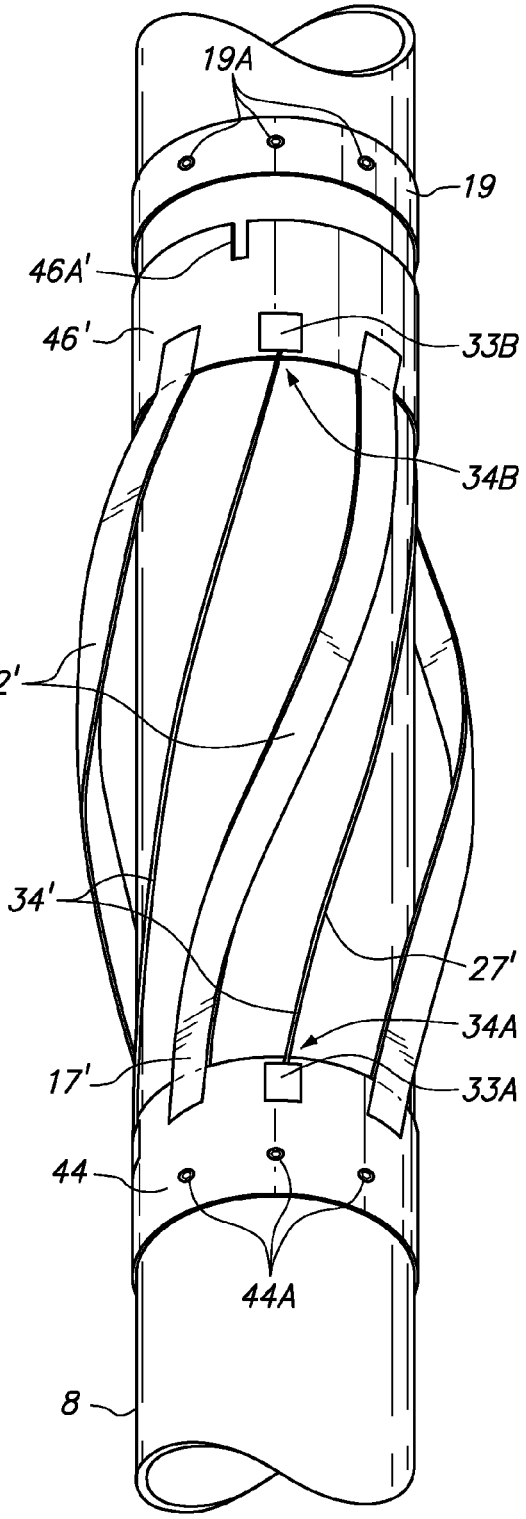
FIG. 8 is the actuator and centralizer of FIG. 7 in an activated and expanded mode to provided stand-off between the tubular and a bore in which the tubular may be disposed.

FIG. 8 is the actuator 27' and the centralizer 17' of FIG. 7 in an actuated and expanded mode, respectively, to expand the ribs 42' of the centralizer 17'. The shape-memory elements 34' are contracted in length to forcibly rotate the second collar 46' about the tubular 8 in the direction indicated by the arrow 46B. The forced rotation of the second collar 46' relative to the first collar 44 causes deployment of the ribs 42' to the deployed mode illustrated in FIG. 8.

It should be understood that the radial expansion of the centralizer 11 as shown in FIG. 2, centralizer 19 as shown in FIG. 4, centralizer 15 as shown in FIG. 6, and centralizer 27 as shown in FIG. 8 would, if the tubular 8, the respective actuators and centralizers installed thereon were disposed within a bore of an installed casing or within a borehole, position the tubular 8 generally toward the center of that bore upon actuation by the actuator. These actuators and centralizers are illustrated in FIGS. 1-8 in a condition removed from a borehole to better reveal the various components.

Figure 9:
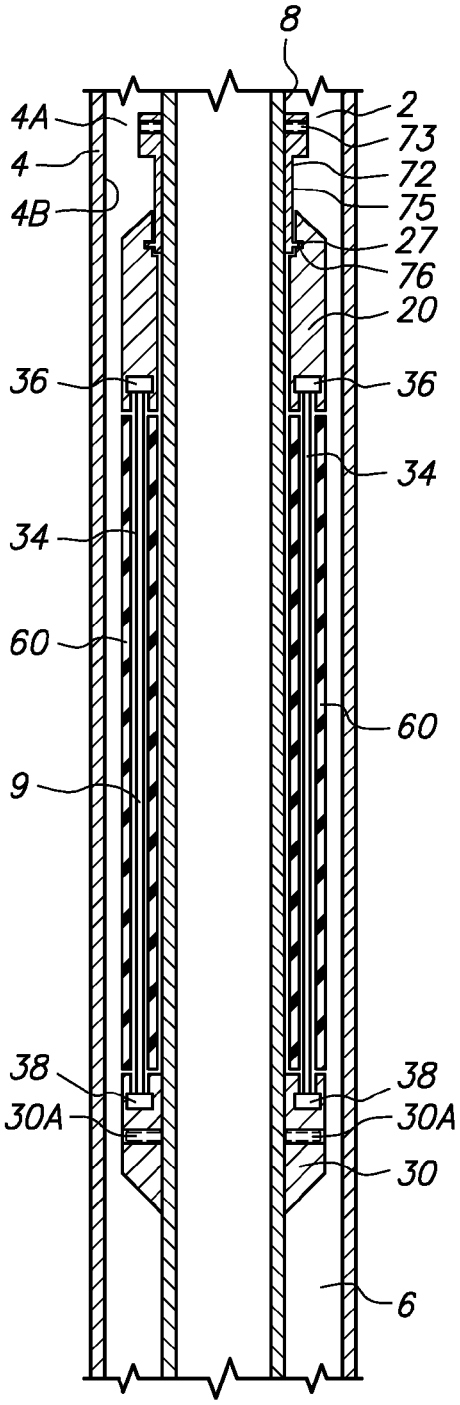
FIG. 9 is an elevation section view of a temperature activated actuator coupled to a packing member between a moving collar and an anchor collar and installed on a tubular disposed within a bore.

FIG. 9 is an elevation view of one embodiment of a packing member 60 coupled to a temperature activated actuator 9 comprising a plurality of shape memory elements 34, the packing member 60 and actuator 9 installed on a tubular 8 in its run-in configuration and positioned within a bore 4A of a casing 4. The actuator 10 comprises a moving collar 20 slidably received on the tubular 8 and an anchor collar 30 is coupled to the tubular 8 so that the distance separating the anchor collar 30 from the moving collar 20 may vary by movement of the moving collar 20 along the tubular 8. A cylindrical sleeve elastomeric packing member 60 having a bore there through receiving the tubular 8 is disposed intermediate the moving collar 20 and the anchor collar 30.

Figure 10:
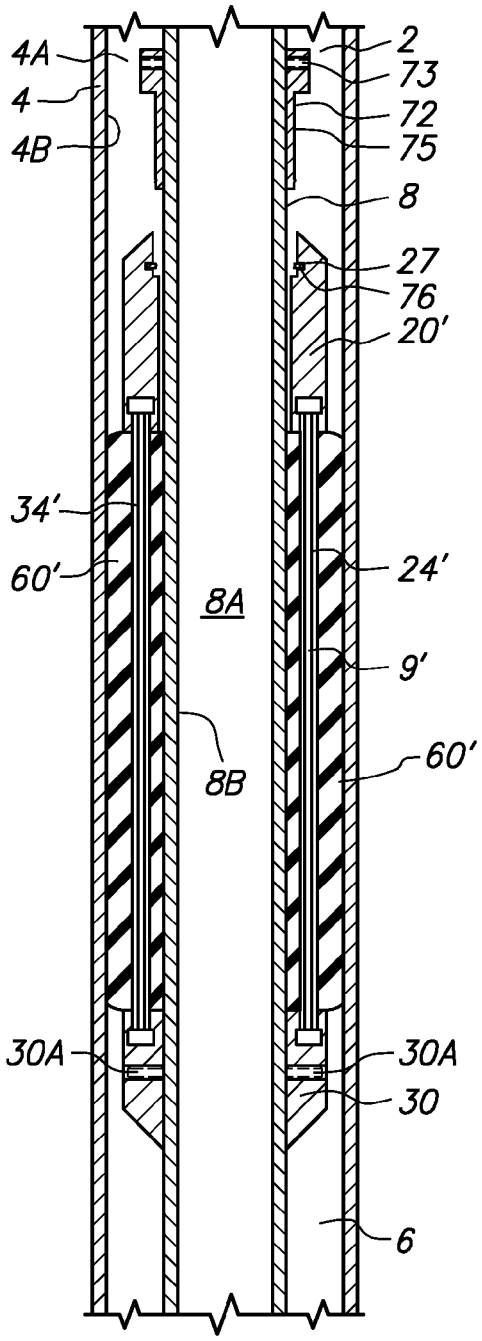
FIG. 10 is the actuator and packing member of FIG. 9 in an activated and isolating mode, respectively.
Figure 13:
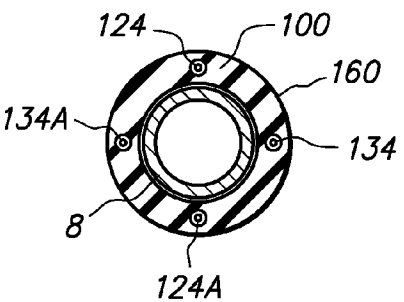
FIG. 13 is a section view of the actuator and packing member of FIG. 11.

The actuator 9 illustrated in FIG. 9 comprises elongate shape-memory elements 34 having a first end 36 coupled to the moving collar 20 and a second end 38 coupled to the anchor collar 30. The anchor collar 30 may be secured in position on the tubular 8 using set screws 30A. Alternately, the anchor collar 30 may be secured in place on the tubular 8 using in other ways, e.g. it may be heat shrunk onto the tubular or it may be secured to the tubular 8 using an adhesive, such as epoxy. Alternately, the anchor collar 30 may be integral with the tubular 8. The packing member 60 in FIG. 9 is illustrated in the run-in configuration, and the diameter of the largest of the packing member 60, the moving collar 20 and the anchor collar 30 is less than the diameter of the bore 4A of the casing 4 in which the actuator 10 and packing member 60 are disposed, and the annulus first portion 2 is in fluid communication with the annulus second portion 6. FIGS. 9 and 10 show only two shape-memory elements 34, but an embodiment of the actuator 10 may have only one or more than two shape-memory elements, as illustrated in FIG. 13 discussed below. The actuator 10 may be activated by raising the temperature of the shape-memory elements 34 to a transition temperature to contract the length of the shape-memory elements 34 to displace the moving collar 20 toward the anchor collar 30 to expand the packing member 60 there between.

FIG. 10 illustrates a temperature activated actuator 10 and the packing member 60 after actuation from the run-in configuration of FIG. 9 to an expanded configuration by shrinking (e.g., axially) the shape-memory elements 34' to displace the moving collar 20 toward the anchor collar 30 to axially compress and radially expand the packing member 60' there between to engage the wall 4B of the bore 4A of the casing 4 and thereby isolate the annulus first portion 2 from annulus second portion 6.

Figure 11:
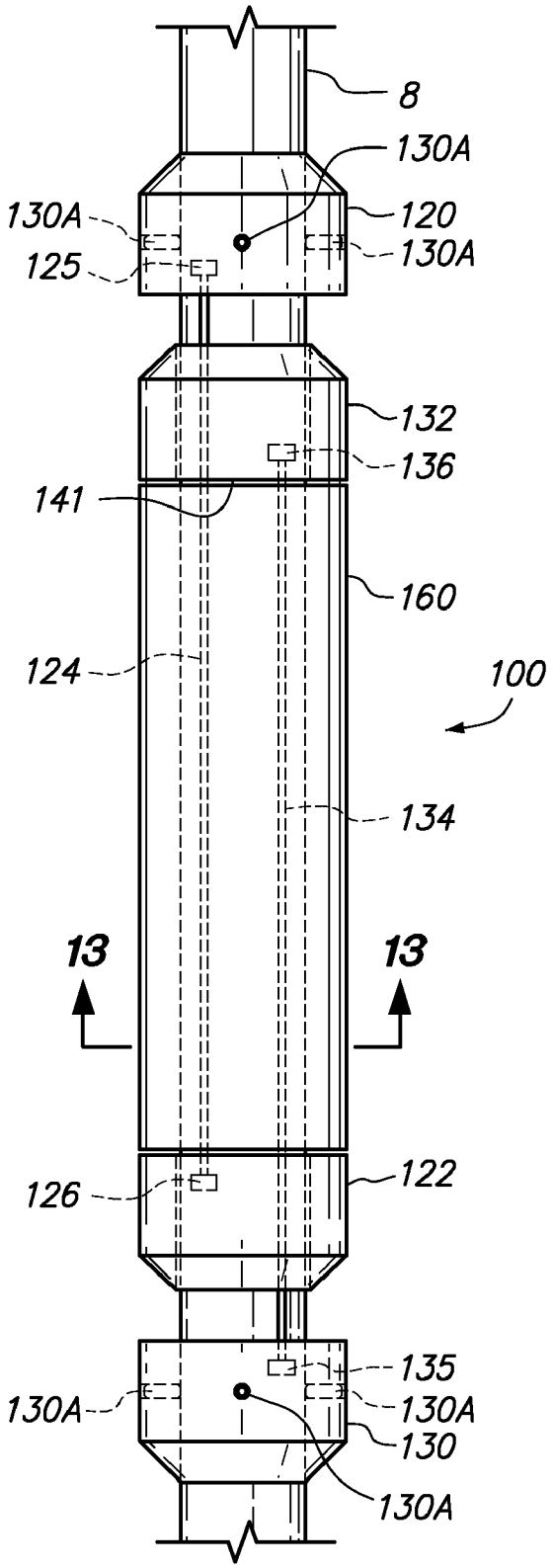
FIG. 11 is an elevation view of an embodiment of a temperature activated actuator coupled to a packing member installed on a tubular.

FIG. 11 is an elevation view of an alternate embodiment of the temperature activated actuator 100 having a plurality of shape-memory elements 124 and 134 arranged in an opposed configuration to actuate a packing member 160 coupled to the actuator 100. "Opposed," as that term is used herein, refers to the shape-memory elements coupled to separate anchor collars spaced one from the other and pulling in separate directions. This arrangement may be used to produce a magnified displacement as compared to the "tandem" arrangement illustrated in FIGS. 9 and 10 in which the shape-memory elements are coupled to a common anchor collar 30 and pull in a common direction.

The packer 100 of FIG. 11 comprises a first shape-memory element 124 and second shape-memory element 134 arranged to adduct a first moving collar 122 and a second moving collar 132 one toward the other to deform the packing member 160 there between. For the reasons stated above, the embodiment of the temperature activated packer 100 of FIG. 11 may double the displacement available relative to using a tandem arrangement of shrink-memory elements illustrated in FIG. 9. Shape-memory element 124 of FIG. 11 is coupled at a first end 125 to a first anchor collar 120 and at a second end 126 to a first moving collar 122. The first anchor collar 120 may be secured in place on the tubular 8 by set screws 130A. First shape-memory element 124 may contract at a transition temperature to move the first moving collar 122 toward the first anchor collar 120. Second shape-memory element 134 is coupled at a first end 135 to a second anchor collar 130 and at a second end 136 to a second moving collar 132. The second anchor collar 130 may be secured in place on the tubular 8 by set screws 130A. As a result, the second shape-memory element 134 may contract at the transition temperature to move the second moving collar 132 toward the second anchor collar 130. Depicted cylindrical sleeve-shaped deformable packing member 160 is disposed between the first moving collar 122 and the second moving collar 132. In one embodiment, the packing member 160 may comprises an elastomeric material such as, for example, rubber.

As a result of the opposed configuration of the first and second shape-memory elements 124 and 134, the packing member 160 may be axially compressed and radially expanded between the adducted first and second moving collars 122 and 132 to approximately double the amount that it would have been compressed and expanded had the first and second shape-memory elements 124 and 134 been coupled in a tandem arrangement to pull in a common direction. That is, in such an embodiment, the first moving collar 122 may be moved toward the first anchor collar 120 by contraction of the first shape-memory element 124, and the second moving collar 132 may be moved toward the second anchor collar 130 by contraction of the second shape-memory element 134. It will be understood that such a resulting adduction of the first moving collar 122 and the second moving collar 132, and the resulting axial compression of the packing member 160 there between, may be approximately double the adduction obtained by tandem arrangement illustrated by FIGS. 9 and 10. It should be understood that the amount of displacement obtainable from any given shape-memory element is generally a function of the length of the shape-memory element, and the amount of force that can be generated by a shape-memory element to displace, for example, a component of an actuatable device is a function of the diameter and/or thickness of the narrowest portion of the shape-memory element.

Although FIG. 11 shows two shape-memory elements 124 and 134 disposed in an opposed relationship, an actuator 100 of this embodiment may comprise a greater number of shape-memory elements to generate greater force upon actuation. For example, but not by way of limitation, the first moving collar 122 may be coupled to a first anchor collar 120 through two or more shape-memory elements 124 angularly distributed about the axis of the tubular 8 to provide an evenly distributed adducting force to move the first moving collar 122 towards the first anchor collar 120. Similarly, the second moving collar 132 may be coupled to a second anchor collar 130 through two or more shape-memory elements 134 angularly distributed about the axis of the tubular 8 to provide an evenly distributed adducting force to move the second moving collar 132 towards the second anchor collar 130. It should be noted that the shape-memory elements may or may not be longitudinally aligned with the axis of the tubular. Similarly, in some embodiments, a shape-memory element may be coupled to the packer in a spiral and/or helical configuration about the axis of the tubular, e.g., similar to the centralizer embodiments described above. Because a shape-memory element may be coupled to contract in a tensile mode, a shape-memory element may be adapted to function in non-linear or non-aligned configurations. For example, but not by way of limitation, the shape-memory elements of FIGS. 7 and 8 are non-linear as they follow a generally spiral or helical path about a portion of a tubular 8.

Figure 12:
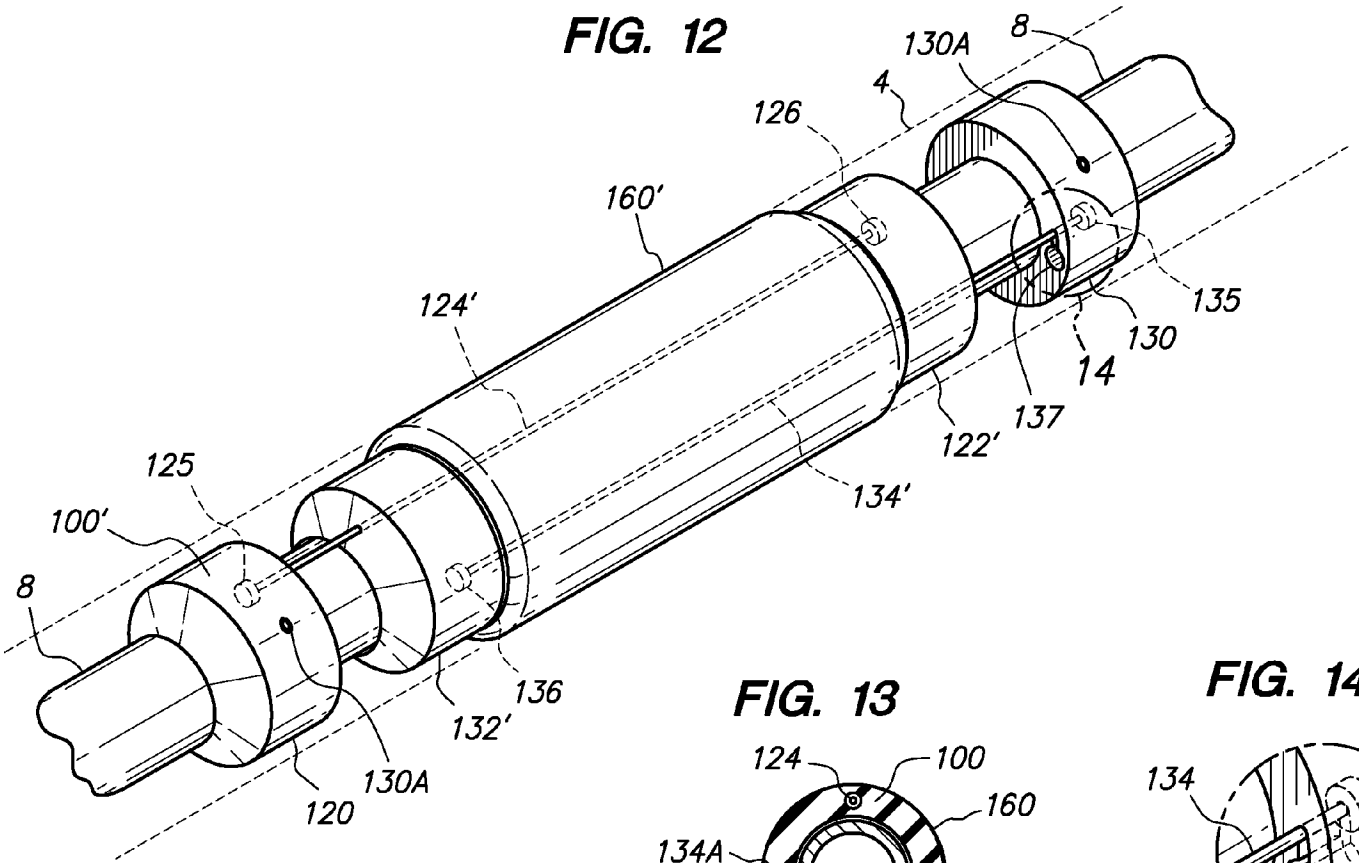
FIG. 12 is the actuator and packing member of FIG. 11 in an activated and isolating mode, respectively, to isolate an annulus first portion from an annulus second portion within a bore in which the tubular may be installed.

FIG. 12 is a perspective view of the embodiment of the temperature activated actuator 100 and packer 160 of FIG. 11 after the packing member 160' is actuated to an expanded mode. The contraction of the shape-memory elements 124, 134 results in the adduction of the first moving collar 122' and the second moving collar 132' to axially compress and radially expand packing member 160' to the isolating mode to engage the wall of a bore (not shown in FIG. 12).

FIG. 13 is cross-section view of the embodiment of the temperature activated packer of FIG. 11. FIG. 13 illustrates the arrangement of the depicted temperature activated actuator 100 having four shape-memory elements 124, 124A, 134 and 134A angularly distributed and disposed within channels in the packing member 160 around the tubular 8. In one embodiment, the shape-memory elements 124, 124A, 134 and 134A may be disposed, for example, within the interior bore of the packing member 160 along the tubular 8, and that the number and positions of the shape-memory elements may vary in other embodiments.

Figure 14:
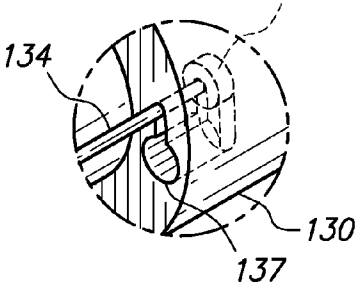
FIG. 14 is an enlarged view of an embodiment of a coupling between a shape-memory element and a collar.

FIG. 14 is an enlarged view of a coupling between a first end 135 of a shape-memory element 134 and a collar 130. The first end 135 illustrated in FIG. 14 comprises an enlarged head received within a recess, e.g., a generally "L"-shaped recess 137, machined into the fixed collar 130. A coupling may be used to preload the shape-memory element 134 by pulling the shape-memory element 134 and the moving collar 132 coupled to the second end 136 thereof to axially compress the packer 160 (see FIG. 12), e.g., enough to install the first end 135 of the shape-memory element 134 in the captured position illustrated in FIG. 14. In such an embodiment, the resulting residual tension in the shape-memory element 134, caused by the resilient packer 160 acting to restore the moving collar 132 to its former position, maintains the coupling between the shape-memory element 134 and the anchor collar 130. It should be understood that a shim(s) may be used to adjust the coupling and thereby dispose the shape-memory elements in a state of residual tension. For example, shim(s) may be inserted between a packer and an anchor collar, or between a packer and a moving collar. It should be understood that a coupling like that illustrated in FIG. 14 may be used to couple the shape-memory element 134 to either an anchor collar 130 or a moving collar 132, or both. It should be understood that the coupling illustrated in FIG. 14 is but one of many couplings that can be employed to connect the end of a shape-memory element to a portion of at least one of the temperature activated actuator, the actuatable device and the tubular.

Figure 15:
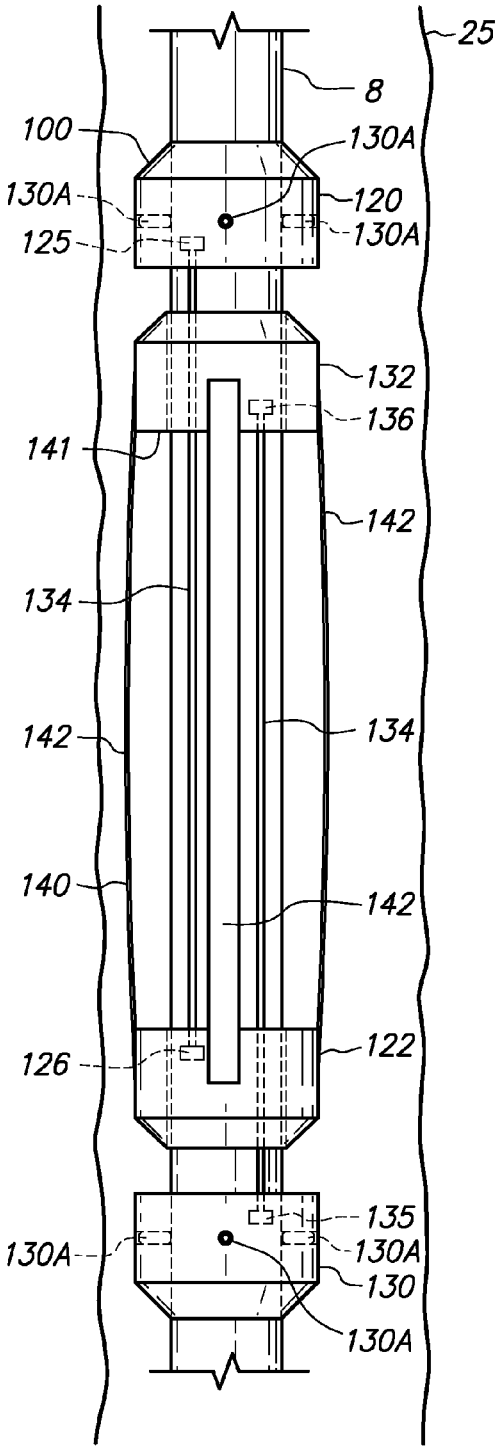
FIG. 15 is an elevation view of the embodiment of the temperature activated actuator of FIG. 11 coupled to a centralizer and installed on a tubular.

FIG. 15 is an elevation view of an alternate embodiment of a temperature activated actuator 100 to produce a magnified displacement and coupled to a tubular 8 with a centralizer 140 having a plurality of generally flexible ribs 142. The actuator 100 may be of the same general construction as the actuator 100 of FIGS. 11 and 12, but coupled to a centralizer instead of a packing member. The centralizer 140 of FIG. 15 is actuated by adduction of the first moving collar 122 and the second moving collar 132, one toward the other, to radially expand the centralizer 140 by deploying a plurality of bow springs 142. The temperature of the shape-memory elements 134 may be raised to contract the shape-memory elements in length to adduct the first and second moving collars 122 and 132 one toward the other to bow the ribs 142.

Figure 16:
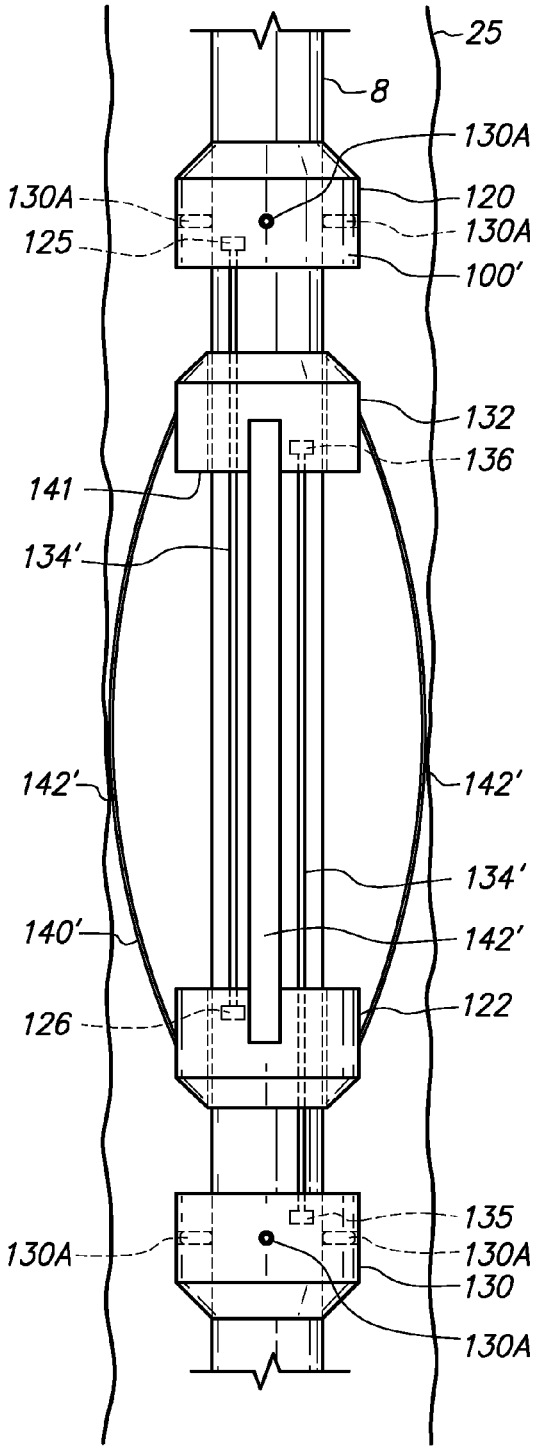
FIG. 16 is the actuator and centralizer of FIG. 15 in an activated and expanded mode, respectively, to provide stand-off between the tubular and a bore in which the tubular may be installed.
Figure 17:
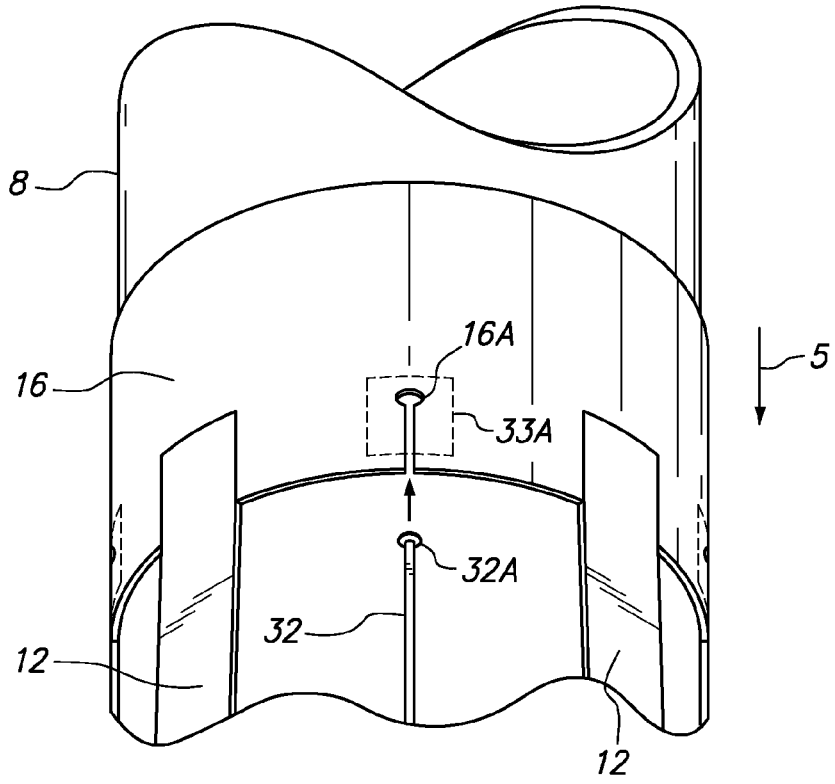
FIG. 17 is a perspective view of a coupling that may be used to couple an end of a shape-memory element to a collar.
Figure 18:
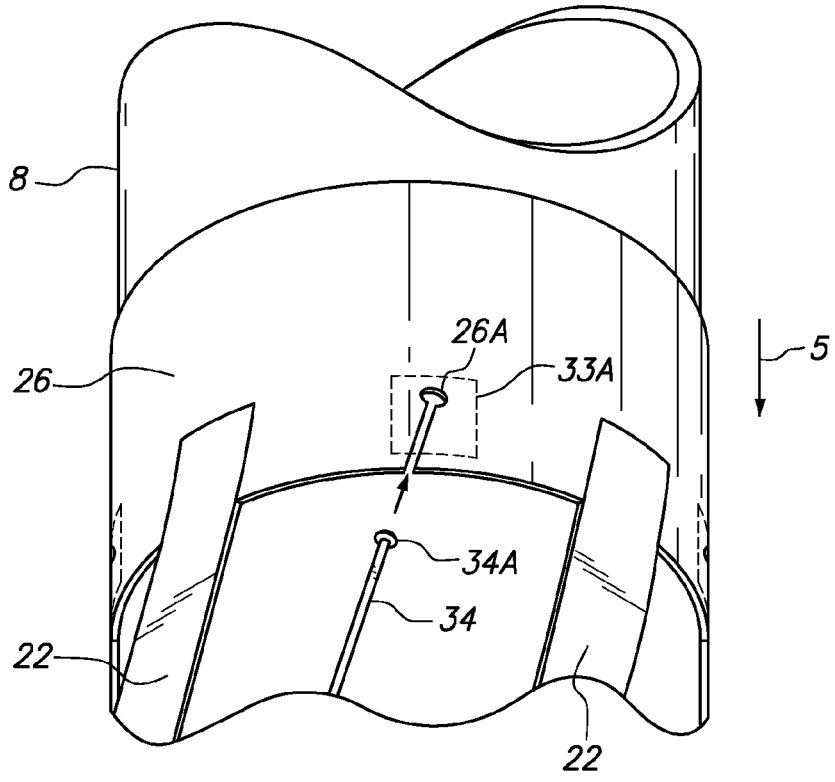
FIG. 18 is a perspective view of an alternative coupling that may be used to couple an end of a shape-memory element to a collar.

FIG. 16 is the actuator 100 and centralizer 140' of FIG. 15 in an activated and expanded mode, respectively, to radially expand the ribs 142' of the centralizer 140'.

It should be noted that the actual contraction of the shape-memory elements depicted in FIGS. 2, 4, 6, 8, 10, 12 and 16 is not to scale, and actual lengthwise contraction of shape-memory elements might be, for example, about 5% of its length. For a 91 cm (36-inch) shape-memory element, for example, a contraction of almost about 5 cm (about 2 inches) may be achieved, not accounting for resistance to contraction due to loading.

Contraction of a shape-memory element can provide considerable force for deforming a centralizer, as illustrated in FIGS. 2, 6, 8, and 16 or a packing member, as illustrated in FIGS. 10 and 12. For example, an elongate shape-memory element comprising a nickel-titanium alloy and having about a 0.318 cm (about 0.125 inch) diameter may, when restrained from contraction, produce about 2.8 kN (about 625 pounds) of tension within the element, corresponding to approximately about 0.38 kN/sq. mm (about 55,000 psi) of tensile stress capacity.

The use of the term "shrink," as that term is used herein, generally refers to the contraction of an elongate member to a shorter overall length, and does not necessarily mean that the actual volume of the shape memory element is reduced. For example, a shape memory element may be subjected to a transition temperature and thereby caused to contract (i.e., "shrink") from a length of about 91 cm (about 36 inches) to a length of about 87 cm (about 34.2 inches), while the diameter of the shrink-memory element may radially expand from a diameter of about 0.64 cm (about 0.25 inches) to a diameter of about 0.65 cm (about 0.257 inches). Accordingly, while the shape memory element may be said to "shrink" from about 91 cm (about 36 inches) to about 87 cm (about 34.2 inches), in reality the shape memory element is reconfigured from the second configuration to the first configuration, and the term "shrink" should not be taken to mean that the volume of the shape memory element has changed in proportion to the change in the overall length.

A shape-memory element may be coupled to, for example, a fixed collar, moving collar or other structure in a variety of ways including, but not limited to, forming a head and/or an upset or enlarged portion on the shape-memory element, and by receiving the head and/or an upset or enlarged portion of the shape-memory element into a recess, cavity, receptacle, catch or other structure adapted for retaining (e.g., releasably) the shape memory element coupled to the structure, or vice versa. Alternately, the shape-memory element may be coupled to, for example, an anchor collar, moving collar or other structure by forming threads on the shape-memory element and threadably engaging the threads with a threaded aperture, hole, recess or fitting on or in the structure. Alternately, a clamp, dog, slip or other mechanical structure may be used to couple the shape-memory element to structures of the packing member to enable the contraction of the shape-memory element, upon exposure to a transition temperature, to provide movement of at least one component of the packing member.

The term "tubular," as used herein to refer to the central body or member about which the illustrated embodiments are constructed, may be, in one embodiment, a tubular string, a tubular segment, a mandrel, pipe, tube or sub. In some embodiments, a bore of the tubular may be adapted for receiving a plug to prevent flow, for example, through a packing member coupled to an actuator described herein. The tubular may comprise a plurality of tubulars and other structures coupled one to the others to form a continuous bore there through.

An embodiment of the actuator may be adapted for being activated (e.g., controlled) by manipulation of the tubular and/or the fluid pressure to which the actuator is exposed. For example, but not by way of limitation, an embodiment of the actuator comprising a battery and electrical resistor to raise the temperature of a shape-memory element to a transition temperature may further comprise a sensor, e.g. a pressure sensor, and may comprise a microprocessor coupled to the battery to monitor a downhole condition, e.g. the pressure, to which the actuator is exposed. The microprocessor may be programmed to close the circuit including the electrical resistor upon detection of a setpoint condition, e.g. a set pressure, or upon a second detection of a setpoint condition, e.g. a setpoint pressure, occurring within a set time interval.

For example, but not by way of limitation, a microprocessor may be programmed to monitor the pressure detected at a pressure sensor and, when the pressure exceeds a preset threshold within a preset period of time, the microprocessor causes closure of the circuit to the electrical resistor and raises the temperature of the shape-memory element to activate the actuator. It will be understood that a variety of methods of activation of an embodiment of an actuator may be used.

In one embodiment, a holding member or retaining mechanism may be used to hold (e.g., retain) the actuator in the activated mode, or to hold or retain the actuatable device in the actuated mode. For example, a linear ratchet comprising an elongate member with teeth disposed thereon may interact with a ratchet tooth that is spring-biased to engage the teeth along the elongate member, and to index along the teeth, one at a time, in a first direction, but to lock and prevent movement of the elongate member in a second, opposite direction. Such a holding member or retaining mechanism may be used to permit adduction of a first collar and a second collar and to prevent separation of the adducted first collar and second collar.

An embodiment of the actuator used in a vertically deep borehole where increasing geothermal temperature during running of the actuator may cause partial contraction of the shape-memory elements. An actuator for this application may comprise a clutch, a latch or a mechanical fuse to prevent unwanted premature deployment during the running of the actuator to the targeted interval of the borehole. For example, an embodiment of the temperature actuated actuator may comprise a mechanical fuse, such as a shear pin, coupled intermediate one or more shape-memory elements such that less than a threshold amount of force provided by tension within the shape-memory element would be restrained from deploying the actuatable device, e.g. the packer or centralizer, by the shear pin. At a threshold amount of force, the shear pin would fail, and the shape-memory element may then contract and thereby actuate the device to, e.g., for a packing member, to expand and seal against the wall of the bore in which the packing member is disposed or, for a centralizer, to expand and position the tubular within a bore in which the centralizer is disposed. For example, but not by way of limitation, FIG. 9 illustrates an embodiment of a mechanical fuse that may be used for this purpose. Retainer 72, which may be formed as a collar or sleeve, may be received and secured in place on the tubular 8 using set screws 73. Retainer 72 may comprise one or more legs 75 extending there from to position one or more shear pins 76. Shear pins 76 may be received within a recess 27 within the moving collar 20 to retain the moving collar 20 against movement away from the retainer 72.

As the temperature of the shape-memory element 34 is increased to the transition temperature, a mechanical fuse may prevent premature activation of the temperature activated actuator 9 by retaining the moving collar 20 in its original position relative to the retainer 72 as illustrated in FIG. 9, until the tension in the shape-memory elements 34 reaches a predetermined threshold amount corresponding to the size and metallurgical properties of the shear pin, etc. At that threshold amount of tension, the one or more shear pins 76 fail and thereby release the moving collar 20 from the retainer 72. Upon release, the moving collar 20 is displaced by the tension in the shape-memory elements 34 to the position illustrated in FIG. 10 to, in the embodiment of the actuator 10 illustrated in FIGS. 9 and 10, displace the packing member 60 to its expanded and isolating configuration illustrated in FIG. 10. It should be understood that the mechanical fuse device illustrated in FIGS. 9 and 10 could be adapted and used in connection with a centralizer, like those described in connection with FIGS. 1-8, 15 and 16, or for use in connection with any other actuatable downhole device.

Shape memory elements contracted by heating to a transition temperature, as discussed above, may relax (e.g., elongate) when cooled below the transition temperature or a second transition temperature. In some embodiments, it may be necessary to provide a latch to secure the temperature activated actuator in the activated configuration to prevent inadvertent retraction of the actuated device. For example, a temperature activated packing member may, in one embodiment, be activated to the isolating mode by exposure to geothermal heat, and the borehole may be opened to a flow line for production from the borehole. Produced fluids, for example, hydrocarbon gas, may result in cooling the shape-memory elements below a transition temperature at which the shape-memory elements may extend or re-elongate from the contracted configuration that disposed the packing member to the isolating mode. A temperature activated packing member may, in one embodiment, be activated by heat from a battery coupled to an electrical resistor. The current from the battery may subside, and the shape-memory element may be cooled as a result, and the shape-memory elements may extend or elongate from the contracted configuration that disposed the packing member to the isolating mode.

An embodiment of the temperature activated actuator may comprise a latch to secure the actuator in the activated mode and/or the actuated device in the deployed, expanded, isolating, open or closed mode. For example, but not by way of limitation, the actuator may comprise a ratchet mechanism that accommodates adduction of, i.e. closure or reduction of the distance separating, a first moving collar and a second moving collar, but prevents or restricts abduction of, i.e. opening or increasing the distance separating, the first and second moving collars where the shape-memory elements are relaxed or re-elongated as a result of cooling to below a transition temperature. One embodiment of such a latch may comprise an elongate rail supporting a plurality of teeth thereon, and coupled to the first collar, and a pivotal tooth coupled to the second collar and disposed to movably engage the teeth on the rail to provide a linear ratchet mechanism. The tooth may be biased towards an engaged position with the teeth of the rail, e.g., using a spring, and/or the ratchet mechanism may be used to prevent inadvertent separation of the collars if, for example, the shape-memory elements should re-elongate due to a decrease in the temperature, or fail. It will be understood that a variety of ratcheting mechanisms, e.g., "one-way" ratcheting mechanisms, exist and can be adapted for this purpose without departing from the spirit of the invention. It should be further understood that an embodiment of a temperature activated actuator may comprise a latch mechanism that is releasable by manipulation of the tubular. For example, but not by way of limitation, a latch may comprise a ratchet mechanism to secure the temperature activated actuator in an isolating mode, and the ratchet may maintain the actuator in the isolating condition as long as the tubular is not subjected to a releasing force, e.g. tension within the tubular, at the actuator. For example, to release the actuator from its activated condition, the tubular may be subjected to a threshold releasing level of force, e.g., placed in tension within the borehole to impart an upward force on the actuator or adjacent device to unseat and release the ratchet, thereby allowing the resilient packing member to separate the first and second moving collars and retract the packing member from the isolating mode.

Embodiments of the temperature activated actuator may be combined with various methods and apparatuses in the art for installing, setting, deploying, retracting and/or retrieving packers without departure from the spirit of the claims that follow.

The terms "comprising," "including," and "having," as used in the claims and specification herein, shall be considered as indicating an open group that may include other elements not specified. The terms "a," "an," and the singular forms of words shall be taken to include the plural form of the same words, such that the terms mean that one or more of something is provided. The term "one" or "single" may be used to indicate that one and only one of something is intended. Similarly, other specific integer values, such as "two," may be used when a specific number of things is intended. The terms "preferably," "preferred," "prefer," "optionally," "may," and similar terms are used to indicate that an item, condition or step being referred to is an optional (not required) feature of the invention.

From the foregoing detailed description of specific embodiments of the invention, it should be apparent that a system for enhancing the quality of cementing operations that is novel has been disclosed. Although specific embodiments of the system are disclosed herein, this is done solely for the purpose of describing various features and aspects of the invention, and is not intended to be limiting with respect to the scope of the invention. It is contemplated that various substitutions, alterations, and/or modifications, including but not limited to those implementation variations which may have been suggested herein, may be made to the disclosed embodiments without departing from the spirit and scope of the invention as defined by the appended claims which follow.

While the invention has been described with respect to a limited number of embodiments, those skilled in the art, having benefit of this disclosure, will appreciate that other embodiments can be devised which do not depart from the scope of the invention as disclosed herein. Accordingly, the scope of the invention should be limited only by the attached claims.

We claim:

1. A method of isolating an annulus first portion from an annulus second portion, comprising:

slidably disposing a first moving collar and a second moving collar on a tubular, intermediate a first anchor collar and a second anchor collar, with the first moving collar being disposed intermediate the second moving collar and the second anchor collar;

disposing a packing member on the tubular intermediate the first moving collar and the second moving collar;

coupling a first end of one or more first shape-memory elements to the first anchor collar and a second end of the one or more first shape-memory elements to the first moving collar;

coupling a first end of one or more second shape-memory elements to the second anchor collar and a second end of the one or more second shape-memory elements to the second moving collar;

disposing the packing member within a bore; and raising the temperature of the one or more first shape-memory elements and the one or more second shape-memory elements to a transition temperature to axially contract the one or more first shape-memory elements and the one or more second shape-memory elements, wherein axial contraction of the one more first shape memory elements causes the first moving collar to move towards the first anchor collar, and axial contraction of the one or more second shape-memory elements causes the second moving collar to move towards the second anchor collar, and wherein moving the first moving collar towards the first anchor collar and moving the second moving collar towards the second anchor collar causes the packing member to radially expand into engagement with wall of the bore.

2. The method of claim 1, wherein the one or more first shape-memory elements comprise a nickel-titanium alloy.

3. The method of claim 1, wherein the tubular comprises a plurality of tubular segments.

4. The method of claim 1, further comprising:

integrally forming at least one of the first anchor collar and the second anchor collar with the tubular.

5. The method of claim 1, wherein raising the temperature of the one or more shape-memory elements comprises disposing the one or more shape-memory elements to a depth in the bore, the bore having a vertical thermal gradient, wherein a temperature at the depth in the bore is sufficient to heat the one or more shape-memory elements to the transition temperature.

6. The method of claim 1, further comprising:

securing the first moving collar and the second anchor collar in an adducted relationship, after moving the first moving collar towards the second anchor collar.

7. A method of actuating a downhole device, comprising:

slidably disposing a first moving collar and a second moving collar on a tubular, intermediate a first anchor collar and a second anchor collar, with the first moving collar being positioned intermediate the second moving collar and the second anchor collar;

disposing an actuatable device on the tubular, intermediate the first moving collar and the second moving collar;

coupling a first end of one or more first shape-memory elements to the first anchor collar and a second end of the one or more first shape-memory elements to the first moving collar;

coupling a first end of one or more second shape-memory elements to the second anchor collar and a second end of the one or more second shape-memory elements to the second moving collar;

disposing the tubular within a bore; and raising the temperature of the one or more first shape-memory elements and the one or more second shape-memory elements to a transition temperature to axially contract the one or more first shape-memory elements to move the first moving collar towards the first anchor collar and to axially contract the one or more second shape-memory elements to move the second moving collar towards the second anchor collar to adduct the first moving collar and the second moving collar and to deploy the actuatable device disposed there between.

* * * * *